United States Patent [19]

Kurrash et al.

[11] Patent Number: 4,580,359

[45] Date of Patent: Apr. 8, 1986

[54] GOLF SHOES

[75] Inventors: Richard F. Kurrash, Atlanta, Ga.; Thomas F. Noone, North Abington, Mass.

[73] Assignee: Pro-Shu Company, Harrisburg, Pa.

[21] Appl. No.: 544,858

[22] Filed: Oct. 24, 1983

[51] Int. Cl.[4] ..... E02F 5/00

[52] U.S. Cl. ..... 36/127; 36/30 R; 36/107; 36/68

[58] Field of Search ..... 36/127, 107, 108, 68, 36/76 R, 76 C, 134, 62, 67 D, 72 A, 73, 30 R

[56] References Cited

U.S. PATENT DOCUMENTS

| | | | |
|---|---|---|---|
| 2,059,386 | 11/1936 | Murphy . | |
| 2,266,697 | 12/1941 | Wilcox . | |
| 2,315,874 | 4/1943 | Sabel | 36/127 |
| 2,322,297 | 6/1943 | Jalbert | 36/108 |
| 2,784,503 | 3/1957 | Anderson . | |
| 2,872,746 | 2/1959 | Maccarone | 36/76 R |
| 3,040,449 | 6/1962 | Phillips . | |
| 3,559,308 | 2/1971 | Bernier et al. . | |
| 3,738,026 | 6/1973 | Granger | 36/127 |
| 4,080,745 | 3/1978 | Torrance . | |
| 4,224,747 | 9/1980 | Winfield | 36/30 R |
| 4,335,528 | 6/1982 | Watanabe . | |
| 4,354,318 | 10/1982 | Frederick | 36/30 R |
| 4,367,600 | 1/1983 | Cross et al. . | |

*Primary Examiner*—Werner H. Schroeder
*Assistant Examiner*—Mary A. Ellis
*Attorney, Agent, or Firm*—Harness, Dickey & Pierce

[57] ABSTRACT

An improved golf shoe construction of the so-called "soft" variety. This golf shoe includes a sole comprised of an outsole layer and a midsole layer between which a plurality of spike retaining sockets are located. Attached to the midsole is a wedge shaped heel piece. According to one aspect of this invention, a cross shaped stabilizer shank is affixed between the midsole and heel piece. This shank design provides improved lateral arch aid support and enhances the torsional stiffness of the shoe. According to another aspect of this invention, the outsole and midsole are stitched and bonded together thus providing redundant attachment means thereby preventing delamination.

1 Claim, 5 Drawing Figures

GOLF SHOES

BACKGROUND AND SUMMARY OF THE INVENTION

This invention relates to sport shoes and particularly to a novel construction for golf shoes.

A golf shoe must firmly and securely support the user's foot and must prevent slipping during use. The latter requirement is fulfilled by providing a plurality of spikes projecting from the shoe bottom and mounted thereto by internally threaded sockets between layers making up the shoe sole. Shoe stiffness and support is achieved according to the prior art by employing a strengthening shank made of a metal or another material disposed within the shoe sole. It is desirable, however, to provide an improved shank which provides greater torsional stiffness and lateral support for the user's foot than provided by existing shank designs. It is, accordingly, a principal aspect of this invention to provide an improved golf shoe shank which enhances the torsional rigidity and lateral arch support of the shoe.

Manufacturers of golf shoes now offer so-called soft-type construction shoes which have a substantially flat bottom outsole, a midsole layer and a heel wedge positioned between the shoe insole and the midsole. These shoes are typically constructed by employing adhesive bonding compounds between the above-mentioned layers making up the sole. Thus, if the bonding agents fail due to any one of a number of potential causes, the shoe components become separated, which often requires that the shoes be replaced. Accordingly, it is a further principal aspect of this invention to provide stitching between the shoe midsole and outsole to provide redundant means for fastening the components together. These stitchings obviate problems of premature bonding failure. Although using stitches of thread to fasten together shoe sole parts is well known for welt-type construction shoes, it is not currently employed in connection with so-called soft-type shoes which are of bonded construction.

Additional benefits and advantages of the present invention will become apparent to those skilled in the art to which this invention relates upon a reading of the described preferred embodiments of this invention taken in conjunction with the accompanying drawings.

DETAILED DESCRIPTION OF THE INVENTION

Figure 1:
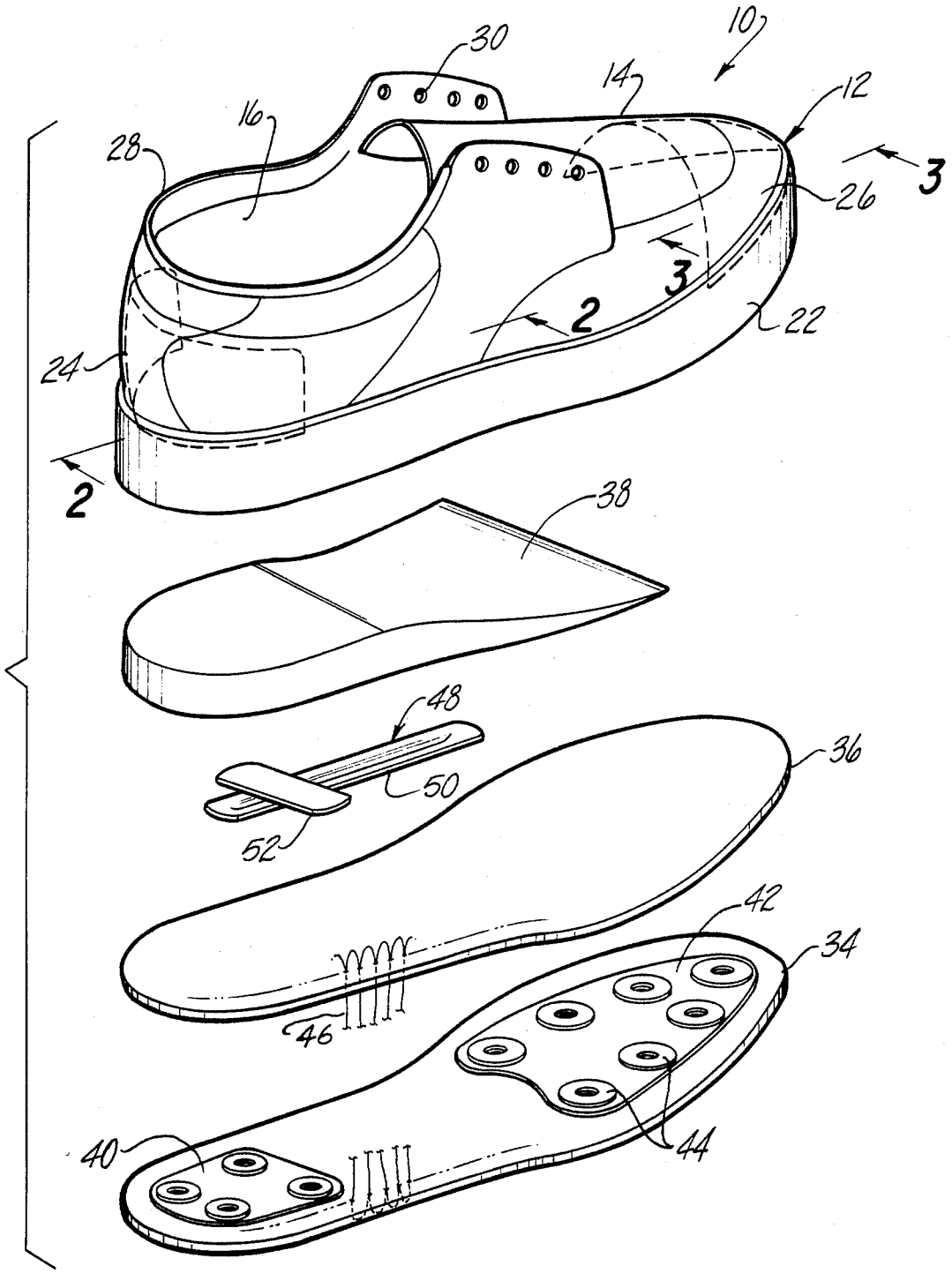
FIG. 1 is an exploded pictorial view showing the components of a golf shoe embodying the principal aspects of this invention.
Figure 3:
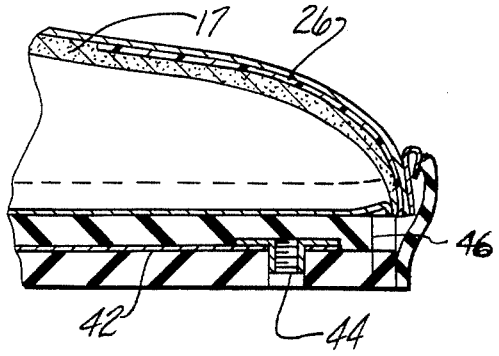
FIG. 3 is a partial sectional view of a golf shoe according to this invention taken along lines 3—3 of FIG. 1 showing in detail the construction of the shoe toe portion.
Figure 2:
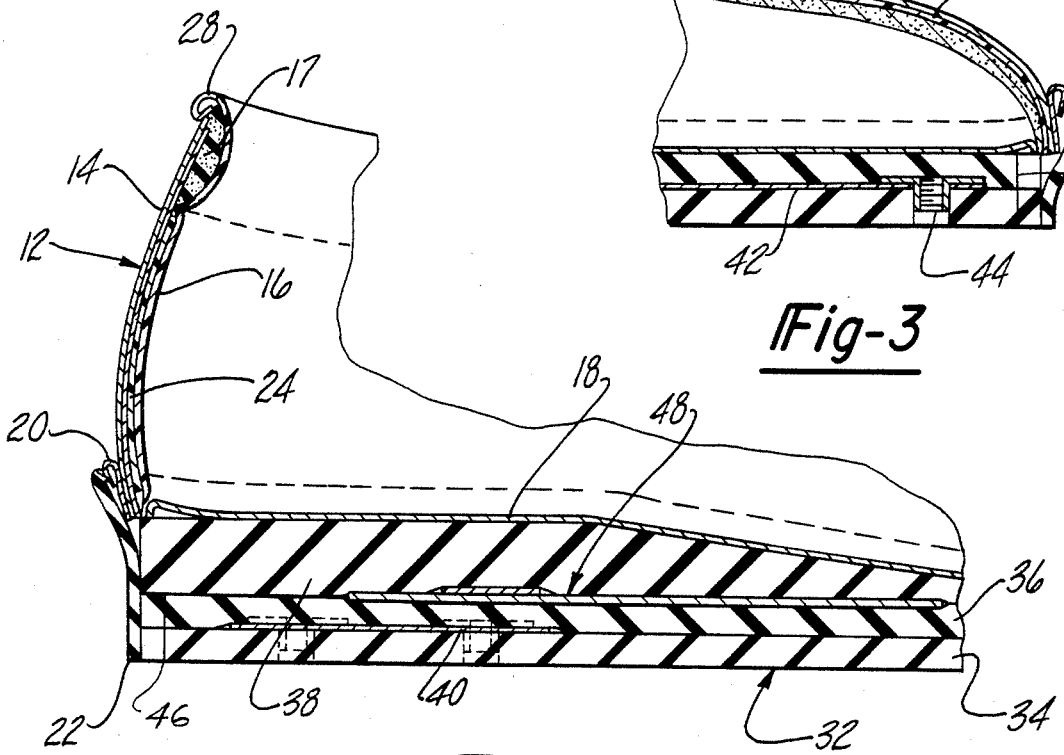
FIG. 2 is a partial sectional view taken along lines 2—2 of FIG. 1 showing in detail the construction of the heel portion of a shoe constructed according to this invention.
Figure 4:
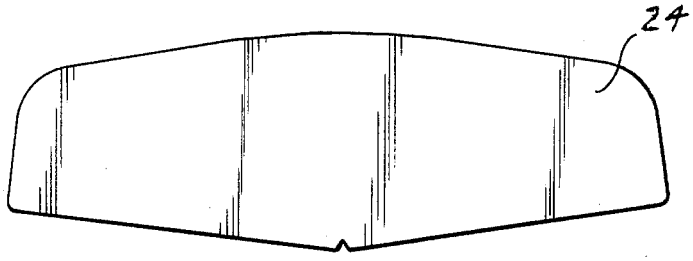
FIG. 4 is a view of the flexible heel reinforcing counter piece.
Figure 5:
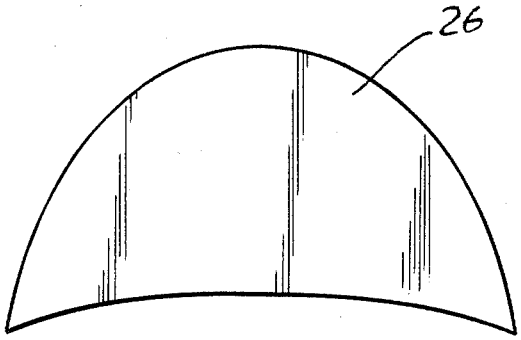
FIG. 5 is a view of the flexible toe reinforcing piece.

A novel golf shoe constructed in accordance with the teachings of this invention is generally designated by reference character 10 and is best shown in detail with reference to FIGS. 1 and 2. Shoe uppers 12 are of conventional soft-type construction. Shoe outer covering 14 composed of a leather or man-made textile is stitched to a padded lining 16. Shoe uppers 12 form lace engaging eyelets 30. Stitched to the bottom periphery of the shoe is insole 18 which is frequently padded and forms an arch support. Shoe outer covering 14 is also stitched to fabric tape 20 along the bottom periphery of the shoe. Attached to tape 20 is wrapper 22 which serves the two-fold function of affixing shoe uppers 12 to the remaining components of the shoe and further acts to provide a pleasing appearance to the shoe by covering the sole layers. Wrapper 22 is made from an elastomeric material and is bonded to the shoe sole and includes free ends which are bonded together. Sewn and cemented within shoe uppers 12 is counter 24 which acts to reinforce the heel area and toe reinforcement 26. These components act to firmly support the associated parts of the wearer's foot by coupling shoe upper 12 to sole 32 and are fabricated from a relatively stiff yet flexible material. Shoe uppers 12 also form a tubular ankle supporting edge 28 which prevents chaffing of the wearer's ankles and prevents the shoe from slipping off. Counter 24 and reinforcement 26 are shown by FIGS. 4 and 5 respectively as die cut components prior to their installation within shoe uppers 12. Components 24 and 26 are sewn or bonded within shoe upper 12 in the position outlined in phantom lines in FIG. 1. The construction for shoe uppers 12 above is provided for illustrative purposes only and does not form a principal part of this invention. As will become evident from the description below, the principal features of this invention may be realized through employing any number of constructions for shoe upper 12.

Shoe sole 32, according to this invention, is constructed by employing outsole piece 34, midsole 36 and heel wedge piece 38. Outsole 34 forms the bottom shoe surface and has a ribbed underside which provides for walking traction and is made of a relatively soft elastomeric material. Midsole 36 and heel wedge 38 are made from a relatively hard elastomeric material. Midsole 36 is a flat layer lying between outsole 34 and heel wedge 38. Heel wedge 38 provides the desired lifting of the wearer's heel. Interposed between midsole 36 and outsole 34 is heel plate 40 and toe pad 42. Heel plate 40 and toe pad 42 provide a mounting surface for a plurality of spike receiving threaded sockets 44. Outsole 34 includes a plurality of spike receiving holes located in registry with sockets 44. Heel plate 40 and toe pad 42 are typically flexible being made from a rubber-like material. Threaded sockets 44, as well as heel plate 40 and toe pad 42 are constructed according to the teachings of the prior art and include means of preventing their rotation with respect to the mounting pad thus allowing the spikes (not shown) to be installed and removed. During construction, outsole 34 and midsole 36 are bonded together using an adhesive compound. Unfortunately, however, bonding failures can and do occur. In the event of such failure the shoe must generally be replaced. The difficulty in achieving a reliable bond between outsole 34 and midsole 36 is increased by the small area of contact between these parts which is lessened by the presence of heel plate 40, toe pad 42 and sockets 44. As a means of enhancing the bonding between outsole 34 and midsole 36 and obviating bonding failures stitching 46 is employed around the entire periphery of sole 32 which firmly affixes the two layers together. Although such stitching of a shoe sole is well-known in connection with welt-type shoe constructions wherein they form an integral structural part of the shoe, they are not known for use in a so-called soft-type shoe construction such as is illustrated herein.

Interposed between midsole 36 and heel wedge 38 is cross bar stabilizer shank 48. Shank 48 is held in position between midsole 36 and heel piece 38 when the pieces are bonded together. Cross bar stabilizer 48 includes elongated portion 50 and a cross bar portion 52. Cross bar portion 52 is affixed to portion 50 by spot welding or adhesive bonding, or it may form an integral part of shank 48. Elongated portion 50 may feature an elongated rib or other means of providing additional stiffening. The provisions of cross bar portion 52 to the shank in the arch area of the shoe results in a significant enhancement of lateral support in that area. This degree of arch support is not achievable with shoe shanks according to the prior art without adversely affecting the desired shoe flexibility characteristics. In addition, shank 48 including cross bar portion 52 acts to provide additional torsional rigidity to the shoe. Insole 36 and heel piece 38 are made from an elastic material of sufficient durometer hardness to prevent cross bar stabilizer 48 from protruding from these parts upon repeated flexation of shoe sole 32.

Shoe upper 12 is attached to sole 32 by adhesive bonding. Wrapper 22 is then turned downward from the shoe upper and bonded to sole 32 using conventional adhesive compounds. Wrapper 22 is then trimmed such that it extends flush with the bottom surface of outsole 34.

While preferred embodiments of the invention have been described herein, it will be appreciated that various modifications and changes may be made without departing from the spirit and scope of the appended claims.

We claim:

1. A golf shoe including uppers for receiving a wearer's foot and having a sole comprising:

a flexible outsole layer, a flexible midsole layer, means for attaching spike retaining sockets interposed between said outsole and midsole layers, said layers being both bonded and stitched together, a wedge shaped heel piece affixed to said midsole layer, a stabilizer shank having mutually perpendicular first and second arms said arms defined by separate components which are connected, said first arm extending between the heel and the toe portions of said sole, said second arm laterally extending and spaced from either end of said first arm, said second arm improving the support provided the wearer by increasing said shoes lateral stiffness and torsional rigidity.

* * * * *

UNITED STATES PATENT AND TRADEMARK OFFICE

CERTIFICATE OF CORRECTION

PATENT NO. : 4,580,359

DATED : April 8, 1986

INVENTOR(S) : Kurrasch et al

It is certified that error appears in the above-identified patent and that said Letters Patent is hereby corrected as shown below:

On the title page, inventor "Kurrash" should be --Kurrasch--.

Signed and Sealed this

Twenty-first Day of October, 1986

[SEAL]

*Attest:*

DONALD J. QUIGG

*Attesting Officer* *Commissioner of Patents and Trademarks*